US007862135B2

(12) United States Patent
Zhang

(10) Patent No.: US 7,862,135 B2
(45) Date of Patent: Jan. 4, 2011

(54) METHOD OF DRIVING LIQUID EJECTING HEAD AND LIQUID EJECTING APPARATUS

(75) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 605 days.

(21) Appl. No.: 11/923,441

(22) Filed: Oct. 24, 2007

(65) Prior Publication Data

US 2008/0100653 A1 May 1, 2008

(30) Foreign Application Priority Data

Oct. 25, 2006 (JP) ..... 2006-290153

(51) Int. Cl.
*B41J 29/38* (2006.01)

(52) U.S. Cl. ..... 347/10; 347/11

(58) Field of Classification Search ..... None
See application file for complete search history.

(56) References Cited

U.S. PATENT DOCUMENTS 6,328,398 B1 * 12/2001 Chang ..... 347/11
6,464,315 B1 * 10/2002 Otokita et al. ..... 347/9
6,598,950 B1 * 7/2003 Hosono et al. ..... 347/11

FOREIGN PATENT DOCUMENTS

| | | |
|---|---|---|
| JP | 06-340075 | 12/1994 |
| JP | 2000-094672 | 4/2000 |
| JP | 2001-150672 | 6/2001 |
| JP | 2002-127418 | 5/2002 |
| JP | 2004-001562 | 1/2004 |

* cited by examiner

*Primary Examiner*—Omar Rojas
(74) *Attorney, Agent, or Firm*—Workman Nydegger

(57) ABSTRACT

A method of driving a liquid ejecting head is provided. The liquid ejecting head varies pressure of a liquid in a pressure-generating chamber as a result of operating a pressure-generating element by supplying an ejection pulse, to eject liquid drops from a nozzle opening due to the pressure variation. The method includes performing a first contraction and performing a second contraction. In the first contraction, the liquid drops are ejected from the nozzle opening as a result of contracting the pressure-generating chamber. In the second contraction, the pressure-generating chamber is contracted so as to reduce withdrawal towards the pressure-generating chamber, of a meniscus after the ejection of the liquid drops A time from a start of the first contraction to a start of the second contraction is between ¼ to ¾ of a Helmholtz vibration period Tc of the pressure-generating chamber. A time of the first contraction is less than or equal to a natural vibration period Ta of the pressure-generating element.

6 Claims, 4 Drawing Sheets

METHOD OF DRIVING LIQUID EJECTING HEAD AND LIQUID EJECTING APPARATUS

BACKGROUND

1. Technical Field

The present invention relates to a method of controlling a liquid ejecting apparatus, such as an ink jet printer, and to a liquid ejecting apparatus. More particularly, the invention relates to a method of driving a liquid ejecting head that ejects liquid drops from a nozzle opening by operating a pressure-generating element as a result of supplying a driving signal; and to a liquid ejecting apparatus.

2. Related Art

A liquid ejecting apparatus includes a liquid ejecting head that can eject a liquid as drops of liquid, and ejects various types of liquids from the liquid ejecting head. A typical example of the liquid ejecting apparatus is an image recording apparatus, such as an ink jet printer (hereafter simply referred to as "printer"). The printer performs a recording operation as a result of forming dots by ejecting liquid ink as drops of ink onto, for example, a recording sheet (serving as an ejection object onto which ejection is performed) and by causing the ink drops to land onto the recording sheet. In recent years, a liquid ejecting apparatus is applied not only to the image recording apparatus, but also to various types of manufacturing apparatuses, such as a display manufacturing apparatus.

Here, the aforementioned printer is taken as an example. It includes a recording head and a driving-signal generating circuit (driving vibration generating unit). The recording head includes, for example, ink paths and a pressure-generating element (such as a piezoelectric element). The ink paths extend to openings of nozzles extending through a pressure-generating chamber from a common ink chamber (reservoir). The pressure-generating element varies the volume of the pressure-generating chamber. The driving-signal generating circuit generates driving signals that are supplied to the piezoelectric element. The piezoelectric element is driven on the basis of driving pulses, included in the driving signals, from the driving-signal generating circuit, to vary the pressure of ink in the pressure-generating chamber. Then, the variation in pressure is made use of to eject ink drops from the nozzle openings.

In this type of printer, a demand for higher quality of a recording image is causing the ink drops to be ejected to become very small. That is, the diameter of dots that are recorded onto a recording medium, such as a recording sheets is reduced as a result of making the ink drops very small, to achieve higher resolution of the recording image and to reduce the roughness of the image that a person perceives visually in a low-density area. The ink drops may be made very small as a result of reducing the diameter of the nozzle openings. However, when the diameter of the nozzle openings is reduced, processing becomes difficult, thereby tending to reduce precision in addition to increasing costs. In addition, clogging tends to occur as a result of drying of the ink near the nozzle openings, thereby placing a limit on how small the diameter of the nozzle openings can be reduced.

Therefore, a technology which makes ink drops very small without changing the size of the nozzle openings has been proposed. In the technology, this is achieved by controlling a meniscus behavior during the ejection of ink drops by putting some thought in forming a driving signal for driving a piezoelectric element. For example, JP-A-2002-127418 (FIGS. 3 and 4) discloses the following ink jet recording apparatus. In the apparatus, a driving signal is provided with a contraction signal used to temporarily contract a pressure-generating chamber prior to providing a preparation signal used to draw in a meniscus as a result of expanding the pressure-generating chamber before ejecting ink drops. The meniscus is pushed out on the basis of the contraction signal. Then, the subsequent preparation signal is used to locally draw in a portion near the center of the meniscus, so that the ink of very small portions near the center of the drawn-in meniscus are discharged as very small ink drops.

However, when the ink drops are made very small without taking any measures, a fly speed during ejection is reduced. This may cause, for example, bending of the flying, or formation of mists as a result of the ink drops not being able to land onto an ejection object (such as a recording sheet).

Residual vibration of ink becomes a problem after the ejection of ink. That is, the residual vibration causes the meniscus to behave improperly. Therefore, ink drops may be accidentally ejected, or the next ejection of ink drops may be adversely affected. In particular, when very small ink drops are successively ejected in a very short time (such as a few μs), it is desirable to restrict the residual vibration to the extent possible.

SUMMARY

An advantage of some aspects of the invention is that the invention provides a method of driving a liquid ejecting head which can stably eject liquid drops while making the liquid drops very small, and a liquid ejecting apparatus.

According to a first aspect of the invention, a method of controlling a liquid ejecting apparatus according to the invention is a method of controlling a liquid ejecting head that varies pressure of a liquid in a pressure-generating chamber as a result of operating a pressure-generating element by supplying an ejection pulse, to eject liquid drops from a nozzle opening due to the pressure variation. The method includes performing a first contraction and performing a second contraction. In the first contraction, the liquid drops are ejected from the nozzle opening as a result of contracting the pressure-generating chamber. In the second contraction, the pressure-generating chamber is contracted so as to reduce withdrawal towards the pressure-generating chamber, of a meniscus after the ejection of the liquid drops. A time from a start of the first contraction to a start of the second contraction is between ¼ to ¾ of a Helmholtz vibration period Tc of the pressure-generating chamber. A time of the first contraction is less than or equal to a natural vibration period Ta of the pressure-generating element.

According to this structure, the natural vibration of the pressure-generating element can be excited as a result of setting the time of the first contraction step less than or equal to the natural vibration period Ta of the pressures generating element, so that the pressure-generating element can be quickly expanded as a result of making use of the natural vibration. This makes it possible to reduce the quantity of liquid drops compared to that in the related art while providing the fly speed required to cause the liquid drops to land onto predetermined positions on an ejection object. In addition, the time from the start of the first compression step to the start of the second compression step is provided between ¼ to ¾ of the Helmholtz vibration period Tc of the pressure-generating chamber, so that the second compression step is performed at a timing in which the meniscus after the ejection of liquid drops is moving towards the pressure-generating chamber. Therefore, it is possible to reduce the drawing in of the meniscus, to prepare for the next ejection of liquid drops. Consequently, driving can be performed stably at a high speed.

It is desirable that a time of the second contraction be less than or equal to the natural vibration period Ta of the pressure-generating element.

In this structure, the time of the second compression step is set less than or equal to the natural vibration period Ta of the pressure-generating element, so that, in the second compression step, the pressure-generating element can be quickly expanded. This makes it possible to more reliably restrict the drawing of the meniscus towards the pressure-generating chamber. Therefore, the residual vibration of the meniscus provided after the ejection of ink drops may be converged at an earlier stage. When the drawing in of the meniscus is prevented, the meniscus can be brought closer to the liquid drops provided immediately after the ejection. Therefore, it becomes easier for excess liquid of the liquid drops to be incorporated into the meniscus due to surface tension. As a result, the liquid drops can be made even minuter.

It is desirable that the method of driving a liquid ejecting head further include performing expansion in which the pressure-generating chamber is expanded prior to performing the first contraction, wherein a time of the expansion is greater than or equal to the natural vibration period Ta of the pressure-generating element.

According to this structure, the time of the expansion step is set greater than or equal to the natural frequency period Ta of the pressure-generating element, so that the pressure-generating element can be expanded while reducing unnecessary vibration. Therefore, it is possible to stabilize the ejection of liquid drops.

It is desirable that a contraction amount in the first contraction be less than or equal to 50% of an expansion amount in the expansion.

According to a second aspect of the invention, there is provided a liquid ejecting apparatus including a liquid ejecting head and a driving unit. The liquid ejecting head includes a pressure-generating chamber, connecting with a nozzle opening, and a pressure-generating element, capable of causing pressure variation in a liquid in the pressure-generating chamber. The liquid ejecting head is such that the pressure-generating element is operated by supplying an ejection pulse, to cause the pressure variation in the liquid in the pressure-generating chamber, so that liquid drops are ejected from the nozzle opening due to the pressure variation. The driving unit drives the pressure-generating element as a result of supplying the ejection pulse to the pressure-generating element. The ejection pulse includes a first contraction element and a second contraction element. The first contraction element is provided for ejecting the liquid drops from the nozzle opening as a result of contracting the pressure-generating chamber. The second contraction element is provided for contracting the pressure-generating chamber so as to reduce withdrawal towards the pressure-generating chamber, of a meniscus after the ejection of the liquid drops. The driving unit sets a time from a starting end of the first contraction element to a starting end of the second contraction element between ¼ to ¾ of a Helmholtz vibration period Tc of the pressure-generating chamber, and sets a generation time of the first contraction element less than or equal to a natural vibration period Ta of the pressure-generating element.

According to this structure, the natural vibration of the pressure-generating element can be excited as a result of setting the generation time of the first contraction element less than or equal to the natural vibration period Ta of the pressure-generating element, so that the pressure-generating element can be quickly expanded as a result of making use of the natural vibration. This makes it possible to reduce the quantity of liquid drops compared to that in the related art while providing the fly speed required to cause the liquid drops to land onto predetermined positions on an ejection object. In addition, the time from the starting end of the first compression element to the starting end of the second compression element is provided between ¼ to ¾ of the Helmholtz vibration period Tc of the pressure-generating chamber, so the pressure-generating element is expanded at a timing in which the meniscus provided after the ejection of the liquid drops moves towards the pressure-generating chamber. This causes the pressure-generating chamber to be contracted. Therefore, it is possible to reduce the drawing in of the meniscus, to prepare for the next ejection of liquid drops. Consequently, driving can be performed stably at a high speed.

It is desirable that the driving unit set a generation time of the second contraction element less than or equal to the natural vibration period Ta of the pressure-generating element.

In this structure, the generation time of the second compression element is set less than or equal to the natural vibration period Ta of the pressure-generating element, so that the pressure-generating element can be more quickly expanded. This makes it possible to more reliably restrict the drawing of the meniscus towards the pressure-generating chamber. Therefore, the residual vibration of the meniscus after the ejection of ink drops may be converged at an earlier stage. When the drawing in of the meniscus is prevented, the meniscus can be brought closer to the liquid drops provided immediately after the ejection. Therefore, it becomes easier for excess liquid of the liquid drops to be incorporated into the meniscus due to surface tension. As a result, the liquid drops can be made even minuter.

It is desirable that the ejection pulse further include an expansion element that occurs prior to the first contraction element and that causes expansion of the pressure-generating chamber, and that the driving unit set a generation time of the expansion element greater than or equal to the natural vibration period Ta of the pressure-generating element.

According to this structure, the time of generation of the expansion element is set greater than or equal to the natural frequency period Ta of the pressure-generating element, so that the pressure-generating chamber can be expanded while reducing unnecessary vibration. Therefore, it is possible to stabilize the ejection of liquid drops.

It is desirable that the contraction amount in the first contraction step be less than or equal to 50% of the expansion amount in the expansion step.

BRIEF DESCRIPTION OF THE DRAWINGS

The invention will be described with reference to the accompanying drawings, wherein like numbers reference like elements.

DESCRIPTION OF EXEMPLARY EMBODIMENTS

A preferred embodiment of the invention will hereunder be described with reference to the drawings. In the description below, an ink jet printer (hereunder simply referred to as "printer"), shown in FIG. 1, will be used as an example of a liquid ejecting apparatus according to the invention.

Figure 1:
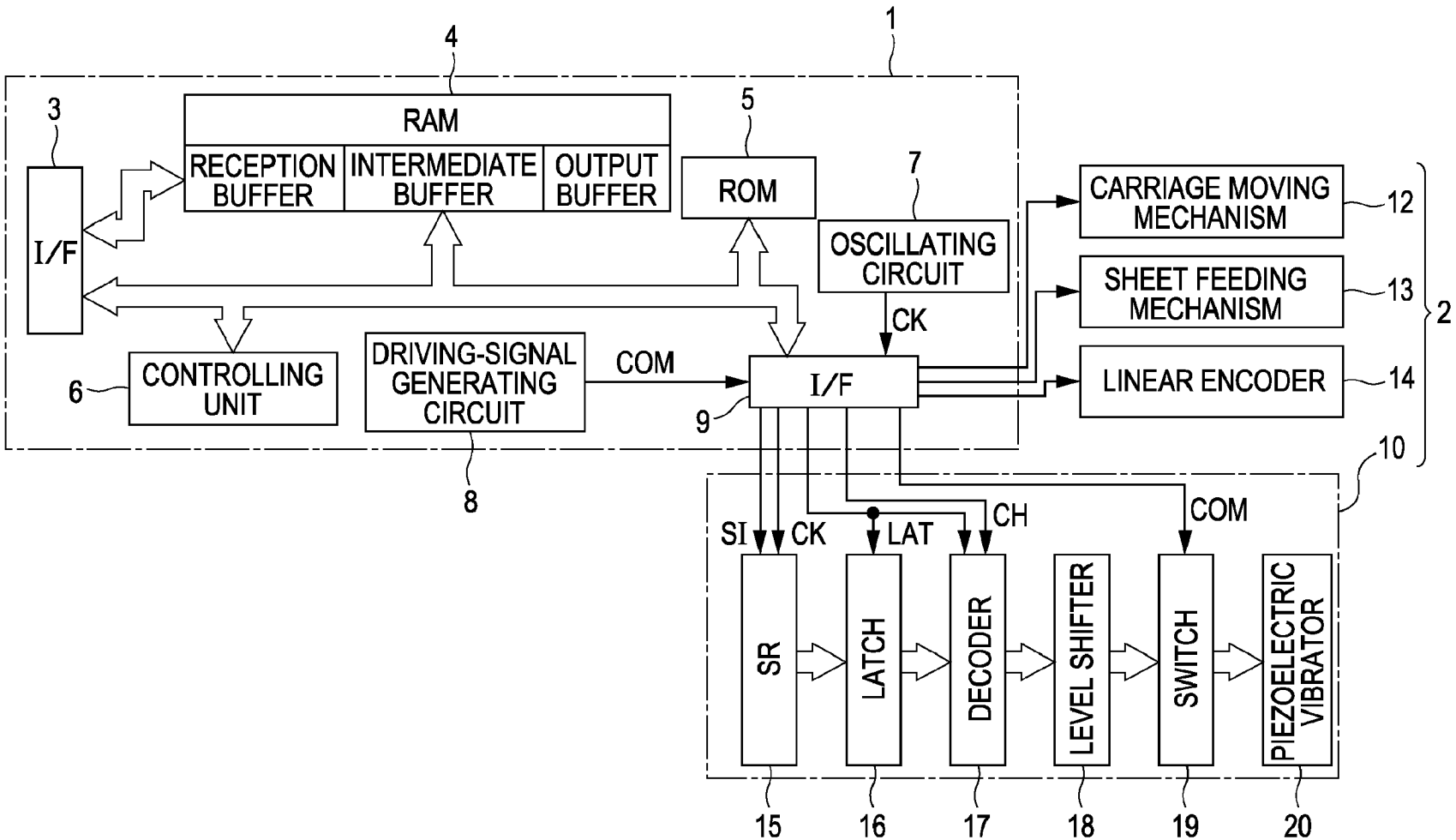
FIG. 1 is a block diagram illustrating an electrical structure of a printer.

FIG. 1 is a block diagram illustrating an electrical structure of the printer. The printer generally includes a printer controller 1 and a print engine 2. The printer controller 1 includes an external interface (external I/F) 3, RAM 4, ROM 5, a controlling unit 6, an oscillating circuit 7, a driving-signal generating circuit 8, and an internal interface (internal I/F) 9. The external I/F 3 performs transmission and reception of data between the printer controller 1 and an external apparatus, such as a host computer. RAM 4 stores, for example, various data. ROM 5 stores, for example, a control routine for various data processing. The controlling unit 6 controls each section. The oscillating circuit 7 generates a clock signal. The driving-signal generating circuit 8 generates a driving signal that is supplied to a recording head 10. The internal IF 9 is for outputting, for example, dot pattern data or the driving signal to the recording head 10.

In addition to controlling each section, the controlling unit 6 converts print data, received from the external apparatus through the external I/F 3, into the dot pattern data. Then, the dot pattern data is output to the recording head 10 through the internal I/F 9. The dot pattern data includes print data, obtained by decoding (translating) gradation data. The controlling unit 6 supplies, for example, a latch signal or a channel signal to the recording head 10, on the basis of the clock signal from the oscillating circuit 7. A latch pulse, included in the latch signal, and a channel pulse, included in the channel signal, define supply timings of the respective pulses of the driving signal.

Figure 2:
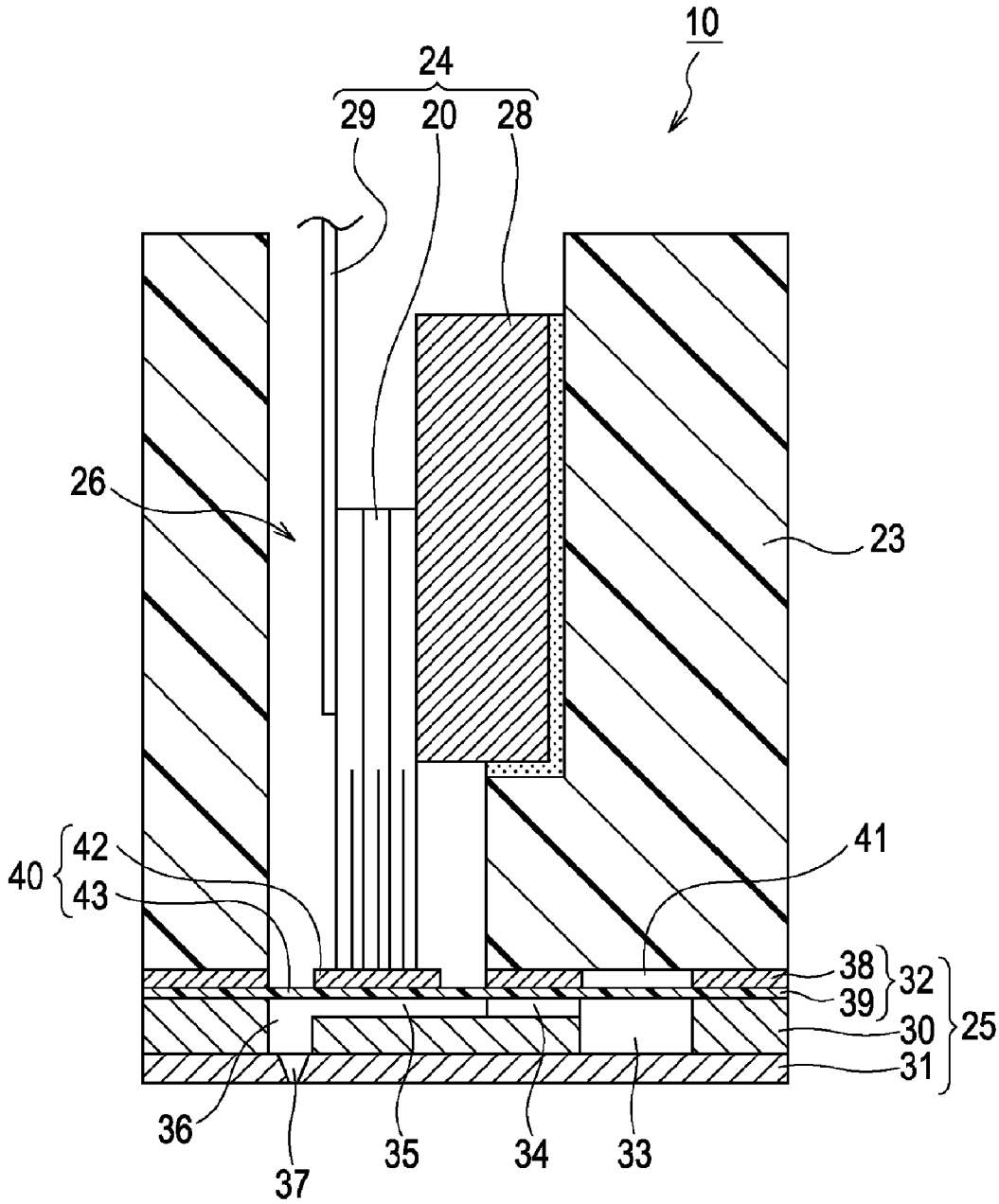
FIG. 2 is a sectional view of a main portion of a structure of a recording head.

The driving-signal generating circuit 8 is controlled by the controlling unit 6, and generates a driving signal for driving a piezoelectric element 20 (refer to FIG. 2). The driving-signal generating circuit 8 in the embodiment is formed so as to generate a driving signal COM in which, for example, an ejection pulse or a micro-vibration pulse is included within one recording period. The ejection pulse is for forming dots onto a recording sheet (one type of ejection object) as a result of ejecting ink drops (one type of liquid drops). The micro-vibration pulse is for mixing ink as a result of micro-vibrating a free surface, that is, a meniscus, of the ink (one type of liquid) exposed to nozzle openings 37 (see FIG. 2).

Next, the print engine 2 will be described. The print engine 2 includes the recording head 10, a carriage moving mechanism 12, a sheet feeding mechanism 13, and a linear encoder 14. The recording head 10 includes a shift register (SR) 15, a latch 16, a decoder 17, a level shifter 18, a switch 19, and the piezoelectric element 20. Dot pattern data (SI) from the printer controller 1 synchronizes with a clock signal (CK) from the oscillating circuit 7, and is serially transmitted to the shift register 15. This dot pattern data is 2-bit data, and is formed by gradation information indicating four recording gradations (ejection gradations) including non-recording (micro-vibration), small dot, intermediate dot, and large dot. More specifically, the non-recording gradation is indicated by gradation information "00," the small-dot gradation is indicated by gradation information "01," the intermediate-dot gradation is indicated by gradation information "10," and the large-dot gradation is indicated by gradation information "11."

The latch 16 is electrically connected to the shift register 15. When a latch signal (LAT) from the printer controller 1 is input to the latch 16, the dot pattern data of the shift register 15 is latched. The dot pattern data latched to the latch 16 is input to the decoder 17. The decoder 17 translates the two-bit dot pattern data to generate pulse selection data. The pulse selection data is formed by making each bit correspond to its corresponding pulse of the driving signal COM. Then, in accordance with the content of each bit, such as "0" or "1," supply or non-supply of an ejection pulse to the piezoelectric element 20 is selected.

The decoder 17 outputs the pulse selection data to the level shifter 18 upon reception of the latch signal (LAT) or a channel signal (CH) In this case, the pulse selection data is input to the level shifter 18 from high-order bit data. The level shifter 18 functions as a voltage amplifier. When the pulse selection data is "1," the level shifter 18 outputs an electrical signal having a voltage that can drive the switch 19, that is, a voltage that is increased to, for example, tens of volts. The pulse selection data "1," in which the voltage is increased at the level shifter 18, is supplied to the switch 19. The driving signal COM from the driving-signal generating circuit 8 is supplied to the input side of the switch 19, and the piezoelectric element 20 is connected to the output side of the switch 19.

The pulse selection data controls the operation of the switch 19, that is, the supplying of a driving pulse in a driving signal to the piezoelectric element 20. For example, when the pulse selection data that is input to the switch 19 is "1," the switch 19 is set in a connected state. Accordingly, a corresponding ejection pulse is supplied to the piezoelectric element 20, so that the electrical-potential level of the piezoelectric element 20 is changed in accordance with the waveform of the ejection pulse. In contrast, when the pulse selection data is "0," the level shifter 18 does not output an electrical signal for operating the switch 19. Therefore, the switch 19 is set in a disconnected state, so that an ejection pulse is not supplied to the piezoelectric element 20

The decoder 17, the level shifter 18, the switch 19, the controlling unit 6, and the driving-signal generating circuit 8, which perform such operations, function as a driving unit in the invention. On the basis of the dot pattern data, a required ejection pulse is selected from the driving signal to apply (supply) it to the piezoelectric element 20. As a result, the piezoelectric element 20 is expanded or contracted. As the piezoelectric element 20 is expanded or contracted, a pressure-generating chamber 35 (see FIG. 2) is expanded or contacted, so that the quantity of ink drops in correspondence with the gradation information of the dot pattern data is discharged from the nozzle opening.

Figure 3:
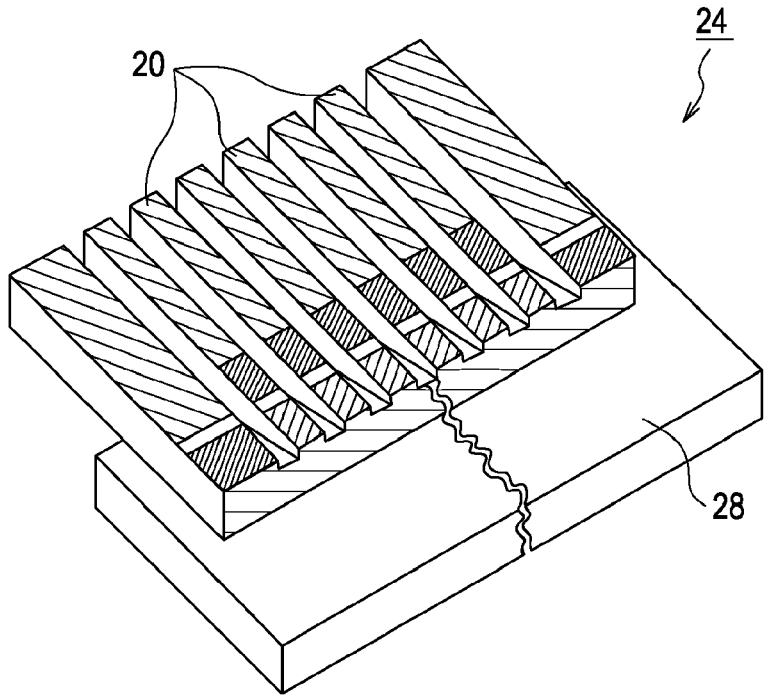
FIG. 3 is a perspective view of a structure of a vibrator unit.

FIG. 2 is a sectional view of a main portion of a structure of the recording head 10 (one type of liquid ejecting head). The recording head 10 includes, for example, a case 23, a vibrator unit 24, and a flow-path unit 25. The vibrator unit 24 is accommodated in the case 23. The flow-path unit 25 is joined to the bottom surface (front end surface) of the case 23. The case 23 is formed of, for example, epoxy resin, and has an accommodation space 26 in its interior for accommodating the vibrator unit 24. The vibrator unit 24 includes the piezoelectric element 20, a stationary plate 28, and a flexible cable 29. The piezoelectric element 20 functions as one type of pressure-generating element. The piezoelectric element 20 is joined to the stationary plate 28. The flexible cable 29 supplies, for example, a driving signal to the piezoelectric element 20. As shown in FIG. 3, the piezoelectric element 20 is a laminated type formed by cutting into a comb form a piezoelectric plate in which piezoelectric layers and electrode layers are alternately laminated. The piezoelectric element 20 operates in a vertical-vibration mode, and is an electrical-field transverse effect type which can expand and contract in a direction perpendicular to the lamination direction (electrical field direction).

The flow-path unit 25 is formed by joining a nozzle plate 31 to one surface of a flow-path substrate 30, and by joining a vibrating plate 32 to another surface of the flow-path substrate 30. The flow-path unit 25 is provided with a reservoir 33 (common liquid chamber), an ink supply opening 34, the pressure-generating chamber 35, a nozzle communicating opening 36, and the nozzle openings 37. Ink paths extending from the ink supply opening 34 to the nozzle openings 37 through the pressure-generating chamber 35 and the nozzle communicating opening 36 are formed in correspondence with the respective nozzle openings 37.

The nozzle plate 31 is a thin metallic plate, formed of, for example, stainless steel, and having the plurality of nozzle openings 37 formed in rows and separated by a pitch (such as 360 dpi) in accordance with a dot-formation density. A plurality of nozzle rows (nozzle groups) are provided in the nozzle plate 31 as a result of providing the nozzle openings 37 in rows. One nozzle row includes, for example, 360 nozzle openings 37.

The vibrating plate 32 has a double structure in which a resilient film 39 is laminated to a surface of a supporting plate 38. In the embodiment, the vibrating plate 32 is formed using a composite plate in which a stainless-steel plate, which is one type of metallic plate, is formed as the supporting plate 38, and a resinous film, serving as the resilient film 39, is laminated to the surface of the supporting plate 38, A diaphragm 40, which changes the volume of the pressure-generating chamber 35, is provided at the vibrating plate 32. A compliance section 41, which seals a portion of the reservoir 33, is provided at the vibrating plate 32.

The diaphragm 40 is formed by removing a portion of the supporting plate 38 by, for example, etching. That is, the diaphragm 40 includes a land 42, to which a tip of a free end of the piezoelectric element 20 is joined, and a thin resilient section 43, which surrounds the land 42. As with the diaphragm 40, the compliance section 41 is formed by removing a portion of the supporting plate 38 at an area opposing the opening plane of the reservoir 33 by, for example, etching. The compliance section 41 functions as a damper that absorbs variations in pressure of a liquid retained in the reservoir 33.

Since the end surface of the piezoelectric element 20 is joined to the aforementioned land 42, the volume of the pressure-generating chamber 35 can be varied as a result of expanding and contracting a free end of the piezoelectric element 20. By varying the volume, the pressure of ink in the pressure-generating chamber 35 is varied. The recording head 10 ejects ink drops of the nozzle openings 37 by making use of this pressure variation.

Figure 4:
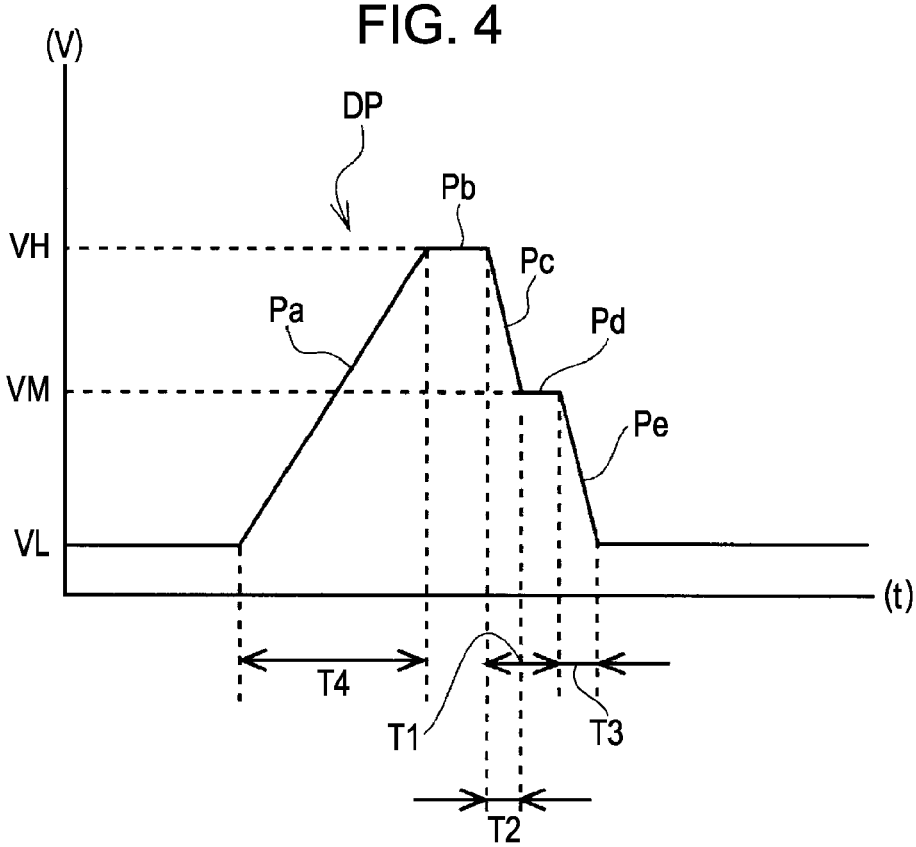
FIG. 4 is a graph of a waveform, for illustrating a structure of an ejection pulse.

FIG. 4 is a graph of a waveform, for illustrating a structure of an ejection pulse DP included in the driving signal COM generated by the driving-signal generating circuit 8 having the above-described structure. The exemplary ejection pulse DP is for ejecting the smallest ink drop among ink drops that can be ejected in the printer according to the embodiment. The ejection pulse DP includes a first charging element Pa (one type of expansion element) a first hold element Pb, a first discharge element Pc (one type of first contraction element), a second hold element Pd, and a second discharge element Pe (one type of second contraction element). At the first charging element Pa, the electrical potential is increased with a constant gradient from a lowest potential VL to a highest potential VH. At the first hold element Pb, the highest potential VH is maintained for a certain time. At the first discharge element Pc, the electrical potential is reduced with a constant gradient from the highest potential VH to an intermediate potential VM. At the second hold element Pd, the intermediate potential VM is maintained for a certain time. At the second discharge element Pe, the electrical potential is reduced with a constant gradient from the intermediate potential VM to the lowest potential VL.

Figure 5A:
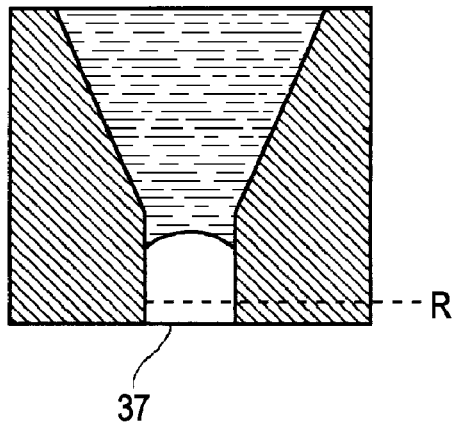
FIGS. 5A to 5C illustrate movements of a meniscus when ejecting ink drops.
Figure 5B:
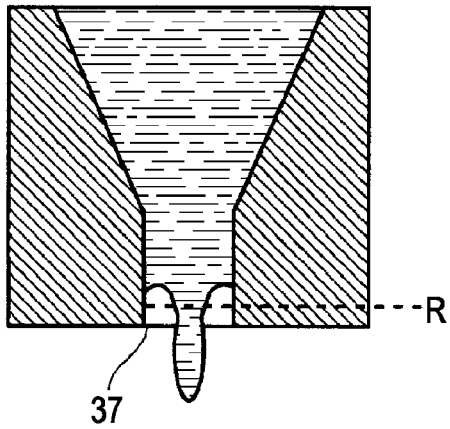
Figure 5C:
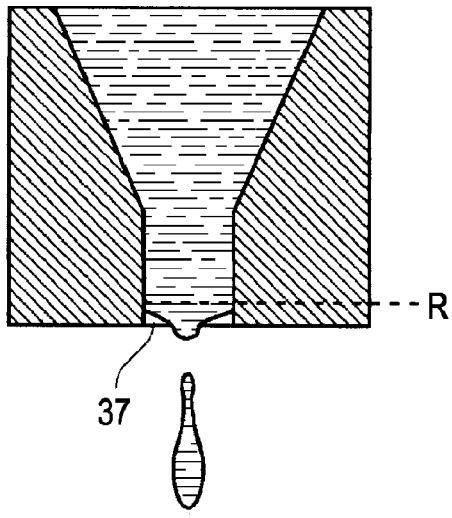

When the ejection pulse DP is supplied to the piezoelectric element 20, the following operations are performed. Firsts when the piezoelectric element 20 is contracted as a result of supplying the first charging element Pa, the pressure-generating chamber 35 expands from a minimum volume (within a range in which the volume can be increased and decreased in accordance with the operation of the piezoelectric element 20) corresponding to the minimum potential VL to a maximum volume (within a range in which the volume can be increased and decreased in accordance with expansion/contraction driving of the piezoelectric element 20) defined by the highest potential VH. (This is called an expansion step.) By this, as shown in FIG. 5A, a meniscus at the nozzle opening 37 is drawn into the pressure-generating chamber 35 by a large amount. The expanded state of the pressure-generating chamber 35 is maintained during the supply time of the first hold element Pb. Thereafter, by supplying the first discharge element Pc, the piezoelectric element 20 is suddenly expanded, so that the volume of the pressure-generating chamber 35 is contracted to a volume corresponding to the intermediate volume VM. (This is called a first contraction step.) Ink in the pressure-generating chamber is compressed by the sudden contraction of the pressure-generating chamber 35, so that, as shown in FIG. 5B, the central portion of the meniscus bulges in a columnar form. This is because the central portion of the meniscus tends to move compared to the peripheral portion of the meniscus (near the inner periphery of the nozzle opening 37), and, thus, tends to follow pressure variation. The contracted state of the pressure-generating chamber 35 is maintained over the supply time at the second hold element Pd. During this time, as shown in FIG. 5C, the columnar portion at the central portion of the meniscus breaks apart, so that the broken portions are discharged from the nozzle openings 37 as a number p1 of ink drops corresponding to small dots. Subsequent to the second hold element Pd, the second discharge element Pe is supplied to the piezoelectric element 20 at a timing in which the meniscus is drawn into the pressure-generating chamber by reaction resulting from the discharge of the ink drops. When the piezoelectric element 20 is further expanded as a result of supplying the second discharge element Pe to the piezoelectric element 20, the pressure-generating chamber 35 is contracted from the volume defined by the intermediate potential VM to a minimum volume defined by the lowest potential VL. (This is called a second compression step.) By this, the drawing of the meniscus into the pressure-generating chamber is restricted, so that the residual vibration of the meniscus is restricted.

Here, in the recording head 10 in the embodiment, the natural vibration period (Helmholtz vibration period) Tc of the ink in the pressure-generating chamber 35 can be determined on the basis of an equivalent circuit in which, the following parameters are determined. They are, for example, inertance indicating the mass of ink per unit length, compliance indicating the change in volume per unit pressure, resistance indicating internal loss of the ink, pressure that the piezoelectric element 20 generates, and volume velocity of, for example, the piezoelectric element 20 and the ink. In addition, for example, the natural vibration period Ta of the piezoelectric element 20 can be determined from, for example, the dimensions, the elastic modulus, and the material density of the piezoelectric element 20. In the printer, while making the ink drops minuter by using the natural vibration periods Tc and Ta, the residual vibration after the ejection is restricted, so that the ink drops are stably discharged. More specifically, in the ejection pulse DP, a time T1 extending from the start of the supply of the first discharge element Pc (that is, of the first compression step) to the start of the supply of the second discharge element Pe (that is, of the second contraction step) is set between ¼ to ¾ of the natural vibration period Tc of the pressure-generating chamber 35. In addition, a first-discharge-element-Pc generation time (first compression step time) T2 is set less than or equal to the natural vibration period Ta of the piezoelectric element 20.

The structure for setting the first-discharge-element Pc generation time T2 (that is, the supply time to the piezoelectric element 20) less than or equal to the natural vibration period Ta is as follows. In the case where a certain voltage change (for example, a voltage change from the highest potential VH to the intermediate potential VM) is applied to the piezoelectric element, when the voltage is changed for a sufficiently longer time than the natural vibration period Ta, the vibration during the natural vibration period Ta can be kept low. In contrast, when the voltage changing time is shorter than the natural vibration period Ta, the vibration during the natural vibration period Ta is excited. When the vibration during the natural vibration period Ta is excited, the oscillating wave (longitudinal vibration wave) is transmitted through the piezoelectric element in the longitudinal direction of the element, so that, compared to the case in which the vibration during Ta is not excited, the piezoelectric element is abruptly displaced. Therefore, when the generation time T2 of the first discharge element Pc is less than or equal to the natural vibration period Ta of the piezoelectric element 20, in the first contraction step, the piezoelectric element 20 is abruptly expanded, thereby abruptly contracting the pressure-generating chamber 35. By this, as shown in FIG. 5B, the central portion of the meniscus that tends to follow pressure variation can be suddenly pushed out in the direction of ejection. As a result, while ensuring the fly speed required for the ink drops to land onto predetermined positions of an ejection object, such as a recording sheet, it is possible to reduce the quantity of ink that is discharged as ink drops from the nozzle openings 37 than when the generation time T2 of the first discharge element Pc is greater than or equal to the natural vibration period Ta.

In the embodiment, the voltage displacement amount of the first discharge element Pc is set so that the contraction amount of the pressure-generating chamber 35 based on the first discharge element Pc in the first contraction step becomes less than or equal to 50% of the expansion amount in the expansion step. That is, when discharging ink drops, restricting the amount of displacement of the piezoelectric element 20 while displacing the piezoelectric element 20 at a high speed makes it possible to further ensure the fly speed of ink drops and make the ink drops minuter.

Accordingly, when ink drops are ejected as a result of displacing the piezoelectric element 20 at a high speed, the residual vibration after ejection becomes a problem. That is, pressure variation during the ejection causes the pressure vibration of the natural vibration period Tc, in which the pressure-generating chamber behaves as if it were an acoustic tube, to be excited in the ink in the pressure-generating chamber 35. When the next ink drop is ejected while the meniscus is unstable due to this residual vibration, ejection characteristics, such as the fly speed of the ink drops or bending in the flying, may be reduced. Therefore, this residual vibration needs to be restricted to the extent possible.

For this reason, in the printer, the time T1 from the starting end of the first discharge element Pc to the starting end of the second discharge element Pe is set between ¼ to ¾ of the natural vibration period Tc of the pressure-generating chamber 35. By this, since the pressure-generating chamber 35 is expanded as a result of expanding the piezoelectric element 20 at a timing in which the meniscus provided after the ejection of ink is drawn into (withdraws towards) the pressure-generating chamber. Therefore, the residual vibration of the meniscus after the ink ejection can be efficiently restricted. By this, even if very small ink drops are ejected at a higher speed, it is possible to prevent the residual vibration of the meniscus, resulting from the ejection operation, from adversely affecting the next ejection operation. As a result, it is possible to perform high-frequency driving of the recording head 10.

In the embodiment, the time of the second contraction step, that is, a generation time T3 of the second discharge element Pe is set less than or equal to the natural vibration period Ta of the piezoelectric element 20. By this, it is possible to displace the piezoelectric element 20 at a high speed in the second contraction step, so that the drawing in of the central portion of the meniscus towards the pressure-generating chamber can be more reliably restricted. As a result, the residual vibration of the meniscus after the ejection of ink drops may be converged at an earlier stage. When the drawing in of the meniscus after the ejection is prevented, the meniscus can be brought closer to the liquid drops provided immediately after the ejection as shown in FIG. 5C. Therefore, it becomes easier for excess ink of the liquid drops to be incorporated into the meniscus. As a result, the liquid drops can be made minuter.

Further, in the embodiment, the time of the expansion step, that is, the generation time of the first charging element Pa is set greater than or equal to the natural vibration period Ta of the piezoelectric element 20. By this, even if the piezoelectric element 20 is driven in the expansion step, it is possible to prevent unnecessary vibration during the natural vibration period Ta. By this, it is possible to stabilize the ejection of ink drops in the first contraction step.

The invention is not limited to the above-described embodiment, so that various modifications may be made on the basis of the scope of the claims.

For example, although, in the embodiment, the ejection pulse DP shown in FIG. 4 is taken as an example of an ejection pulse in the invention, the form of the ejection pulse is not limited thereto. The ejection pulse may take any waveform as long as the ejection pulse includes at least a first charging element Pa (expansion element) for expanding the pressure-generating chamber, a first discharge element Pc (first contraction element) for ejecting ink drops as a result of contracting the expanded pressure-generating chamber, and a second discharge element Pe that contracts the pressure-generating chamber so as to reduce the withdrawal of the meniscus after the ejection towards the pressure-generating chamber.

The invention can also be applied to a liquid ejecting apparatus other than the above-described printer. It can also be applied to, for example, a display manufacturing apparatus, an electrode manufacturing apparatus, or a chip manufacturing apparatus.

What is claimed is:

1. A method of driving a liquid ejecting head that varies pressure of a liquid in a pressure-generating chamber as a result of operating a pressure-generating element by supplying an ejection pulse, to eject liquid drops from a nozzle opening due to the pressure variation, the method comprising:

performing expansion in which the pressure-generating chamber is expanded, wherein a time of the expansion is greater than or equal to a natural vibration period Ta of the pressure-generating element, performing a first contraction after performing the expansion in which the liquid drops are ejected from the nozzle opening as a result of contracting the pressure-generating chamber; and performing a second contraction in which the pressure-generating chamber is contracted after the ejection of the liquid drops, wherein a time from a start of the first contraction to a start of the second contraction is between ¼ to ¾ of a Helmholtz vibration period Tc of the pressure-generating chamber, and wherein a time of the first contraction is less than or equal to a natural vibration period Ta of the pressure-generating element.

2. The method of driving a liquid ejecting head according to claim 1, wherein a time of the second contraction is less than or equal to the natural vibration period Ta of the pressure-generating element.

3. The method of driving a liquid ejecting head according to claim 1, wherein a contraction amount in the first contraction is less than or equal to 50% of an expansion amount in the expansion.

4. A liquid ejecting apparatus comprising:

a liquid ejecting head including a pressure-generating chamber, connecting with a nozzle opening, and a pressure-generating element, capable of causing pressure variation in a liquid in the pressure-generating chamber, the liquid ejecting head being such that the pressure-generating element is operated by supplying an ejection pulse, to cause the pressure variation in the liquid in the pressure-generating chamber, so that liquid drops are ejected from the nozzle opening due to the pressure variation; and a driving unit that drives the pressure-generating element as a result of supplying the ejection pulse to the pressure-generating element, the ejection pulse including an expansion element that causes expansion of the pressure-generating chamber, a first contraction element following the expansion element, and a second contraction element, the first contraction element being provided for ejecting the liquid drops from the nozzle opening as a result of contracting the pressure-generating chamber, the second contraction element being provided for contracting the pressure-generating chamber after the ejection of the liquid drops, wherein the driving unit sets a time from a start of the first contraction element to a start of the second contraction element between ¼ to ¾ of a Helmholtz vibration period Tc of the pressure-generating chamber, and sets a generation time of the first contraction element less than or equal to a natural vibration period Ta of the pressure-generating element, and wherein the driving unit sets a generation time of the expansion element greater than or equal to a natural vibration period Ta of the pressure-generating element.

5. The liquid ejecting apparatus according to claim 4, wherein the driving unit sets a generation time of the second contraction element less than or equal to the natural vibration period Ta of the pressure-generating element.

6. The liquid ejecting apparatus according to claim 4, wherein a contraction amount of the pressure-generating chamber due to the first contract element is less than or equal to 50% of an expansion amount during the expansion.

* * * * *